US008136908B2

(12) United States Patent
Tanaka et al.

(10) Patent No.: US 8,136,908 B2
(45) Date of Patent: Mar. 20, 2012

(54) APPARATUS AND METHOD FOR INK JET PRINTING

(75) Inventors: Hirokazu Tanaka, Tokyo (JP); Yuji Hamasaki, Kawasaki (JP); Hidehiko Kanda, Yokohama (JP); Norihiro Kawatoko, Yokohama (JP); Atsushi Sakamoto, Kawasaki (JP); Toshiyuki Chikuma, Kawasaki (JP); Aya Hayashi, Sendai (JP); Masashi Hayashi, Sagamihara (JP); Jiro Moriyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 232 days.

(21) Appl. No.: 12/691,998

(22) Filed: Jan. 22, 2010

(65) Prior Publication Data

US 2010/0118080 A1 May 13, 2010

Related U.S. Application Data

(62) Division of application No. 11/758,355, filed on Jun. 5, 2007, now Pat. No. 7,735,946.

(30) Foreign Application Priority Data

Jun. 7, 2006 (JP) ..... 2006-158845

(51) Int. Cl.
*B41J 29/38* (2006.01)

(52) U.S. Cl. ..... 347/17; 347/5; 347/6; 347/8

(58) Field of Classification Search ..... None
See application file for complete search history.

(56) References Cited

U.S. PATENT DOCUMENTS

| | | | | |
|---|---|---|---|---|
| 6,406,110 | B1 * | 6/2002 | Ahne et al. | 347/8 |
| 7,494,200 | B2 | 2/2009 | Chikuma et al. | 347/9 |
| 2005/0190219 | A1 | 9/2005 | Chikuma et al. | 347/9 |

FOREIGN PATENT DOCUMENTS

| | | | |
|---|---|---|---|
| JP | 10-095132 | A | 4/1998 |
| JP | 2003-127428 | | 5/2003 |
| JP | 2004-202803 | A | 7/2004 |

OTHER PUBLICATIONS

Translation of JP 2003-127428 A.*

* cited by examiner

*Primary Examiner* — Matthew Luu
*Assistant Examiner* — Justin Seo
(74) *Attorney, Agent, or Firm* — Fitzpatrick, Cella, Harper & Scinto

(57) ABSTRACT

The present invention provides an ink jet printing apparatus and a method for controlling temperature for the ink jet printing apparatus wherein the temperature of a print head, which may lower during printing, is controlled before printing without using any sub-heater to allow a favorable ejection condition to be established without reducing the head temperature below a predetermined value. Thus, scan width information and dot count information are acquired before a carriage starts scanning to determine the heating temperature of the print head on the basis of the information.

7 Claims, 11 Drawing Sheets

| PRINT MEDIUM | PAPER THICKNESS | DISTANCE d BETWEEN HEAD EJECTION PORT SURFACE AND PRINT MEDIUM | PRELIMINARY EJECTION TIME INTERVAL t (SECONDS) | |
|---|---|---|---|---|
| | | | PRESENT EMBODIMENT | CONVENTIONAL TECHNIQUE |
| ORDINARY PAPER | 0.10 | 1.90 | 1 | 1 |
| COAT PAPER | 0.12 | 1.88 | 1 | 1 |
| OHP FILM | 0.15 | 1.85 | 1 | 1 |
| POSTCARD | 0.25 | 1.75 | 2 | 1 |
| PHOTOGRAPHIC SPECIAL PAPER | 0.30 | 1.70 | 3 | 1 |
| ENVELOPE | 0.40 | 1.60 | 5 | 1 |
| CD-R | 1.20 | 0.80 | 10 | 1 |

| DISTANCE d BETWEEN HEAD EJECTION PORT SURFACE AND PRINT MEDIUM | PRELIMINARY EJECTION TIME INTERVAL | | | | |
|---|---|---|---|---|---|
| | 1 SECOND | 2 SECONDS | 3 SECONDS | 5 SECONDS | 10 SECONDS |
| 1.50 | ○ | ○ | ○ | ○ | ○ |
| 1.60 | ○ | ○ | ○ | ○ | △ |
| 1.70 | ○ | ○ | ○ | △ | × |
| 1.80 | ○ | ○ | △ | × | × |
| 1.90 | ○ | △ | △ | × | × |
| 2.00 | △ | × | × | × | × |

FIG.6

| PRINT MEDIUM | PAPER THICKNESS | DISTANCE d BETWEEN HEAD EJECTION PORT SURFACE AND PRINT MEDIUM | PRELIMINARY EJECTION TIME INTERVAL t (SECONDS) | |
|---|---|---|---|---|
| | | | PRESENT EMBODIMENT | CONVENTIONAL TECHNIQUE |
| ORDINARY PAPER | 0.10 | 1.90 | 1 | 1 |
| COAT PAPER | 0.12 | 1.88 | 1 | 1 |
| OHP FILM | 0.15 | 1.85 | 1 | 1 |
| POSTCARD | 0.25 | 1.75 | 2 | 1 |
| PHOTOGRAPHIC SPECIAL PAPER | 0.30 | 1.70 | 3 | 1 |
| ENVELOPE | 0.40 | 1.60 | 5 | 1 |
| CD-R | 1.20 | 0.80 | 10 | 1 |

FIG.7

| DISTANCE d BETWEEN HEAD EJECTION PORT SURFACE AND PRINT MEDIUM | PRELIMINARY EJECTION TIME INTERVAL |
|---|---|
| ~1.50 | 10 |
| 1.51~1.60 | 5 |
| 1.61~1.70 | 3 |
| 1.71~1.80 | 2 |
| 1.81~ | 1 |

FIG.9

APPARATUS AND METHOD FOR INK JET PRINTING

This application is a divisional of application Ser. No. 11/758,355, filed on Jun. 5, 2007.

BACKGROUND OF THE INVENTION

1. Field of the Invention

The present invention relates to an ink jet printing apparatus that performs printing by ejecting ink to print media.

2. Description of the Related Art

Ink jet printing apparatuses have been prevailing which perform printing by moving a print head while ejecting ink onto print media. These ink jet printing apparatuses have been desired to achieve improved print quality because they are sometimes used to print images or the like which are picked up with a digital camera or the like. A factor preventing the ink jet printing apparatus from achieving improved print quality is inappropriate ejection that may occur when the first droplets of ink are ejected from ejection ports after a long interval. The inappropriate ejection may occur if the ink jet printing apparatus has not been used for a long time and when a volatile component of ink vaporizes from ejection ports that communicate with nozzles, increasing the viscosity of the ink. Then, the ejection may be disabled or an impact position may deviate from the correct one depending on the level of the viscosity. This may degrade print quality. With this regard, the ink ejection condition can be recovered by removing the higher-viscosity ink located in the vicinity of the ejection ports. Accordingly, to allow the first droplets to be smoothly ejected, the conventional technique performs preliminary ejection separate from printing ink ejection to eject ink to a position off a print medium to remove the higher-viscosity ink. In this case, the print head, comprising the ejection ports, moves to a dedicated place where the preliminary ejection is to be performed and after the preliminary ejection, returns to a printing position to perform printing again.

However, for the ink jet printing apparatus, there are now growing demands not only for the improved print quality but also for improved weatherability, increased print speed, and the like. To meet these demands, it is desirable to employ ink characterized by improved weatherability and high color developing capability. However, the ink characterized by improved weatherability and high color developing capability tends to have a high viscosity. Accordingly, its use is disadvantageous in allowing the first droplets to be smoothly ejected. Further, when high-viscosity ink is used, the preliminary ejection may be more frequently performed during printing in order to allow the first droplets to be smoothly ejected. However, frequent preliminary ejections require correspondingly frequent movements to the place for preliminary ejection, reducing the print speed. Furthermore, frequent preliminary ejections increase the amount of waste ink ejected during the preliminary ejections instead of being used for printing. Moreover, an increased amount of waste ink requires a waste ink absorber having a large capacity enough to accommodate the waste ink.

SUMMARY OF THE INVENTION

Thus, an object of the present invention is to provide an ink jet printing apparatus that can perform high-quality printing at a high speed by optimizing the number of preliminary ejections during printing.

In the first aspect of the present invention, there is provided an ink jet printing apparatus that prints a print medium using a print head capable of ejecting ink from ejection ports, the ink jet printing apparatus performing a preliminary ejection during a printing operation to eject ink not contributing to image printing, from the ejection ports, the ink jet printing apparatus comprising: varying means for varying time intervals at which the preliminary ejection is repeatedly performed during the printing operation, depending on a distance between the ejection ports and a print surface of the print medium.

In the second aspect of the present invention, there is provided an ink jet printing apparatus that prints a print medium using a print head capable of ejecting ink from ejection ports, the ink jet printing apparatus performing a preliminary ejection during a printing operation to eject ink not contributing to image printing, from the ejection ports, the ink jet printing apparatus comprising: varying means for varying a distance between the ejection ports and a print surface of the print medium depending on time intervals at which the preliminary ejection is repeatedly performed during the printing operation.

In the third aspect of the present invention, there is provided a method for ink jet printing that prints a print medium using a print head capable of ejecting ink from ejection ports, the method performing a preliminary ejection during a printing operation to eject ink not contributing to image printing, from the ejection ports, the method comprising: varying time intervals at which the preliminary ejection is repeatedly performed during the printing operation, depending on a distance between the ejection ports and a print surface of the print medium.

In the fourth aspect of the present invention, there is provided a method for ink jet printing that prints a print medium using a print head capable of ejecting ink from ejection ports, the method performing a preliminary ejection during a printing operation to eject ink not contributing to image printing, from the ejection ports, the method comprising: varying a distance between the ejection ports and a print surface of the print medium depending on time intervals at which the preliminary ejection is repeatedly performed during the printing operation.

The present invention varies the preliminary ejection time interval depending on the distance between the ejection port surface of the print head and the print surface of the print medium. This makes it possible to prevent the inappropriate ejection of the first droplets and a possible decrease in print speed and the possible degradation of the printing capability in association with the ink amount, and to reduce the high demand for the capacity of the waste ink absorber.

Further features of the present invention will become apparent from the following description of exemplary embodiments (with reference to the attached drawings).

BRIEF DESCRIPTION OF THE DRAWINGS

FIG. 6 is a table illustrating a comparison of an ejection condition observed with the preliminary ejection time interval varied and with the distance between an ejection port surface of a print head and a print surface of a print medium varied;

FIG. 7 is a diagram illustrating the relationship between the thicknesses of various print media and the distance between the ejection port surface of the print head and the print medium and the preliminary ejection time interval;

FIG. 9 is a table illustrating the relationship between a distance detected by a sensor and the preliminary ejection time interval;

DESCRIPTION OF THE EMBODIMENTS (First Embodiment)

An embodiment of the present invention will be described below in detail with reference to the drawings.

Figure 1A:
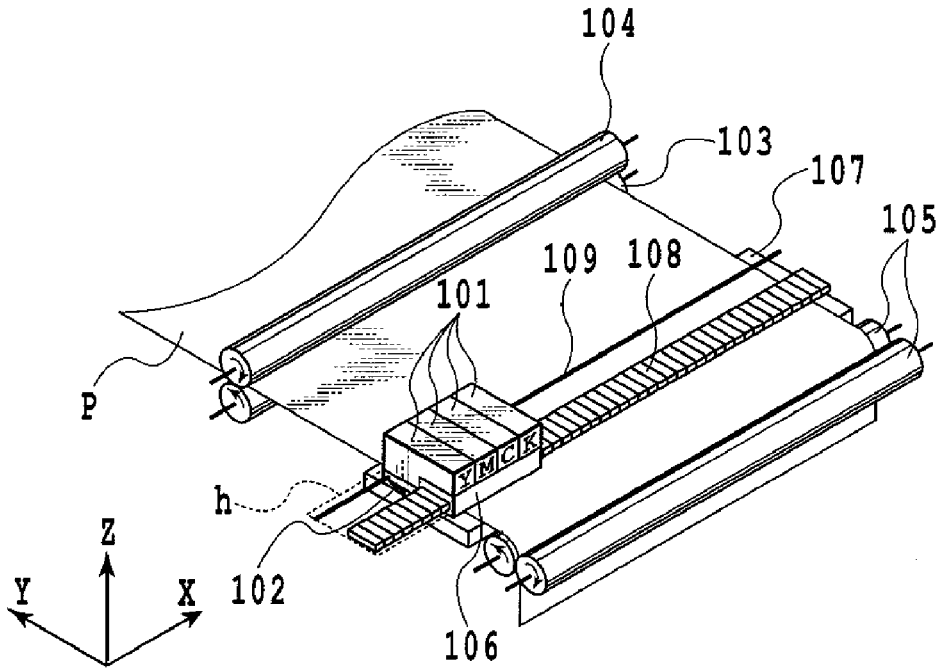
FIG. 1A is a perspective view illustrating an ink jet printing apparatus in accordance with an embodiment of the present invention.
Figure 1B:
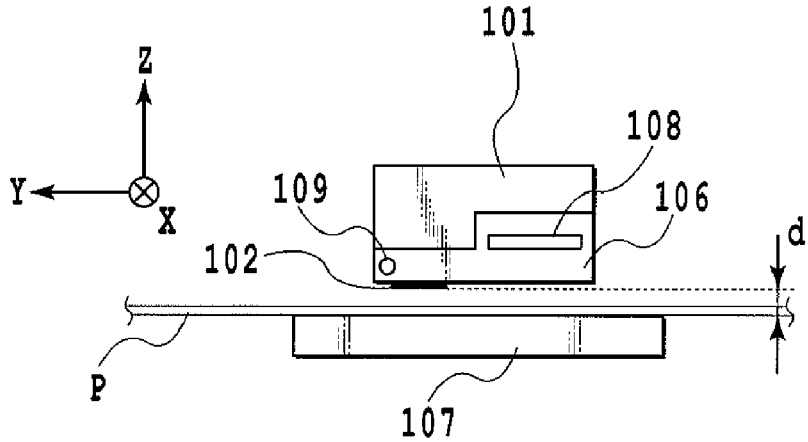
FIG. 1B is a plan view of a side surface of the ink jet printing apparatus in accordance with the embodiment of the present invention.

FIG. 1A is a perspective view illustrating an essential part of an ink jet printing apparatus in accordance with the embodiment of the present invention. FIG. 1B is a side view of the ink jet printing apparatus as viewed from an X direction in FIG. 1A. Four ink cartridges 101 have respective print heads 102 and respective ink tanks independently filled with corresponding color inks in black, cyan, magenta, and yellow. These ink cartridges 101 are mounted on a carriage 106 and are movable in a main scanning direction (X direction) together with the carriage 106. While printing is not being performed, the carriage 106 is back in its home position h to stand by. A paper feeding roller 103 rotates in the direction of an arrow in the figure together with an auxiliary roller 104 while pressing a print medium P. This enables the print medium P to be conveyed in a sub-scanning direction (Y direction). A sheet feeding roller 105 feeds the print medium, and like the paper feeding roller 103 and the auxiliary roller 104, presses the print medium P. A platen 107 supports the print medium P flat at a printing position. A carriage belt 108 is used to allow the carriage 106 to perform scans in the X direction along a shaft 109.

Figure 2:
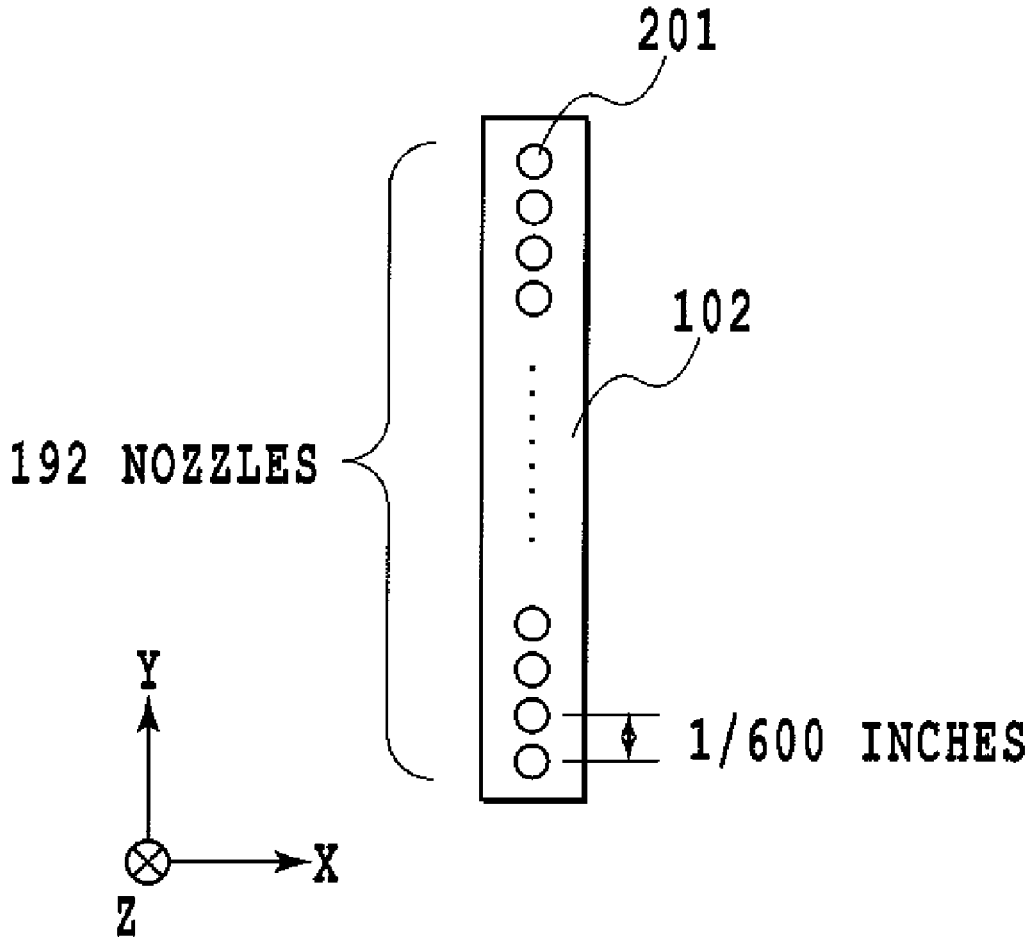
FIG. 2 is a front view illustrating a plurality of ejection ports arranged in a print head in accordance with the embodiment of the present invention.

FIG. 2 is a front view illustrating a plurality of ejection ports 201 arranged in each of the print heads 102. The ink jet printing apparatus in accordance with the present embodiment comprises the four print heads each having ejection ports formed in a line as shown in FIG. 2. The print heads correspond to the four color inks. Each of the print heads 102 has 192 ejection ports 201 arranged at intervals of 1/600 inches so as to provide a print pixel density of 600 dpi. Each of the ejection ports 201 can eject 2 pl of ink, and an ejection frequency required to stably eject ink droplets is 24 kHz. To eject ink droplets at intervals of 1,200 dpi in the main scanning direction, the carriage 106 with the print heads 102 mounted thereon moves at a speed of 24,000 (dots/second) ±1,200 (dots/inch)=20 (inches/second).

Figure 3:
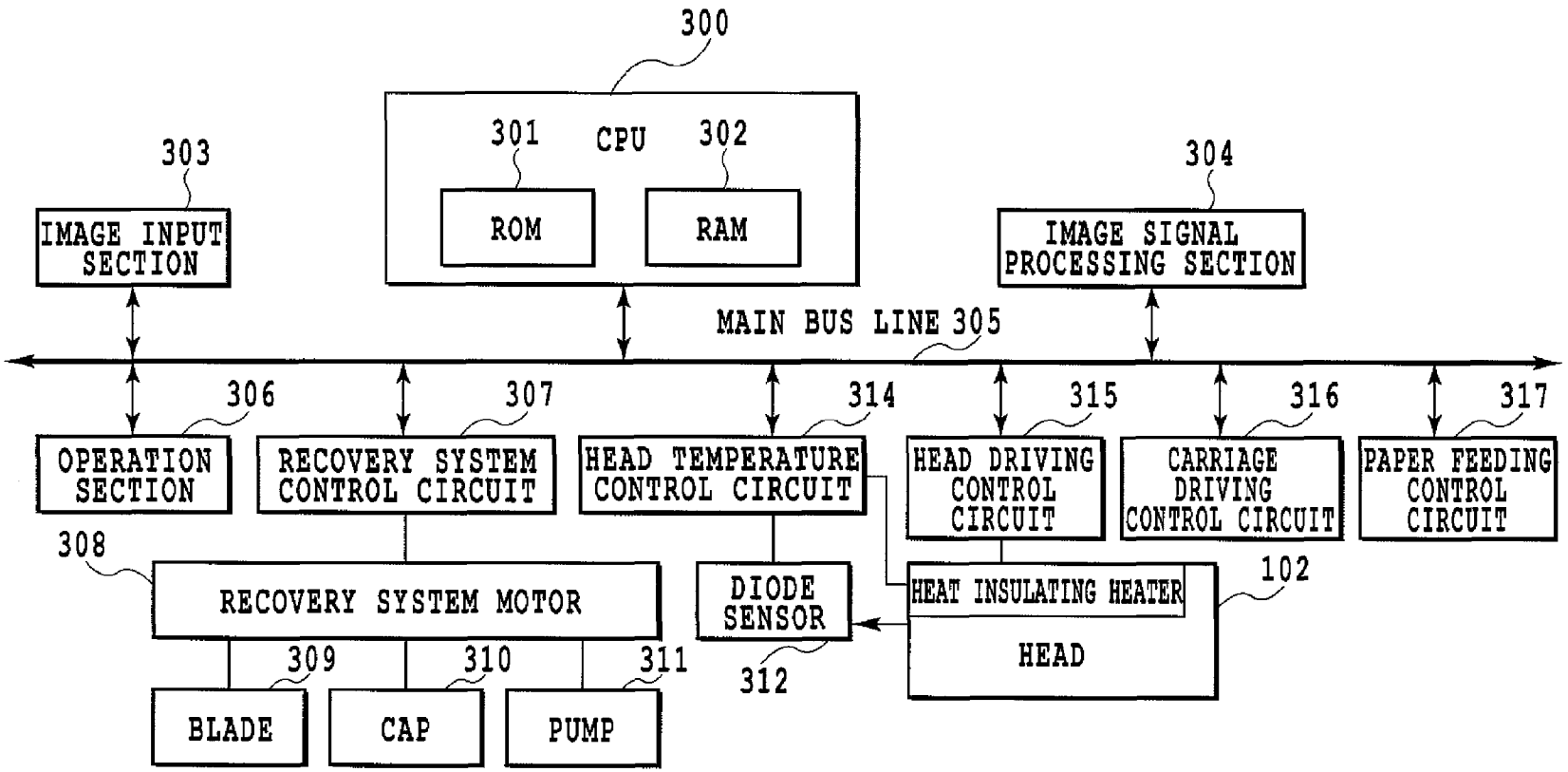
FIG. 3 is a block diagram showing a control arrangement of an ink jet printing apparatus in accordance with a first embodiment of the present invention.

FIG. 3 is a block diagram showing a control arrangement of the ink jet printing apparatus in accordance with the present embodiment. The components connected to a main bus line are divided into software processing means and hardware processing means. The software processing means includes an image input section 303, an image signal processor 304, and a central controlling CPU 300. The hardware processing means includes an operation section 306, a recovery system control circuit 307, a head temperature control circuit 314, a head driving control circuit 315, a carriage driving control circuit 316 that controllably drives the carriage in the main scanning direction, and a paper feeding control circuit 317 that controllably feeds paper in a sub-scanning direction. The CPU 300 normally has a ROM (Read Only Memory) 301 and a RAM (Random Access Memory) 302 and provides print conditions appropriate for input information to drive the print heads 102 for printing. The RAM 302 stores a program for executing a process for recovering the print heads and provides recovery conditions such as preliminary ejection conditions to the recovery system control circuit 307 as required. A recovery system motor 308 drives the print heads 102 described above, a cleaning blade 309 and a cap 310 arranged opposite the print heads 102, and a suction pump 311. The head driving control circuit 315 drives ink ejecting electrothermal converters for the print heads 102 and normally allows the print heads 102 to perform preliminary election or printing ink ejection.

On the other hand, a heat insulating heater may be provided on a circuit board in each of the print heads 102 on which the ink ejecting electrothermal converter is provided. The heat insulating heater can heat the ink in the print head 102 to adjust its temperature to a desired set value. A diode sensor 312 is also provided on the circuit board to measure the substantial temperature of the ink inside the print head 102. Alternatively, the diode sensor 312 may be externally installed rather than on the circuit board and located around the periphery and in the vicinity of the print head 102.

Now, description will be given of a printing operation of the ink jet printing apparatus in accordance with the present embodiment. To start printing, a print start instruction is given to the carriage 106 located in its home position h, shown in FIG. 1. The carriage 106 thus moves in the main scanning direction of the X direction at 20 inches/second. While the carriage 106 is moving, ink is ejected from the plurality of ejection ports in the print heads 102, mounted on the carriage 106, for printing. Once printing is finished up to an end of a print area located opposite the home position h, the paper feeding roller 103 and the auxiliary roller 104 convey the print medium P in a Y direction by a distance (0.32 inches for one pass printing) corresponding to the printed area on the print medium P. The carriage 106 subsequently moves in a −X direction and the carriage 102 starts printing again. Reciprocatory printing is thus repeated in the X and −X directions to completed printing.

While the print medium P is being printed as described above, if an attempt is made to eject ink from an ink ejection port 201 that has not been used for printing for a given time, the ink may be inappropriately ejected from that ink ejection port 201. That is, ink evaporates from the ink ejection port 201 from which ink has not been ejected for the given time. This often increases ink viscosity or causing inappropriate ejection. To prevent this, preliminary ejection is performed in the home position h every time a given time elapses to recover the print heads 102.

Figure 4:
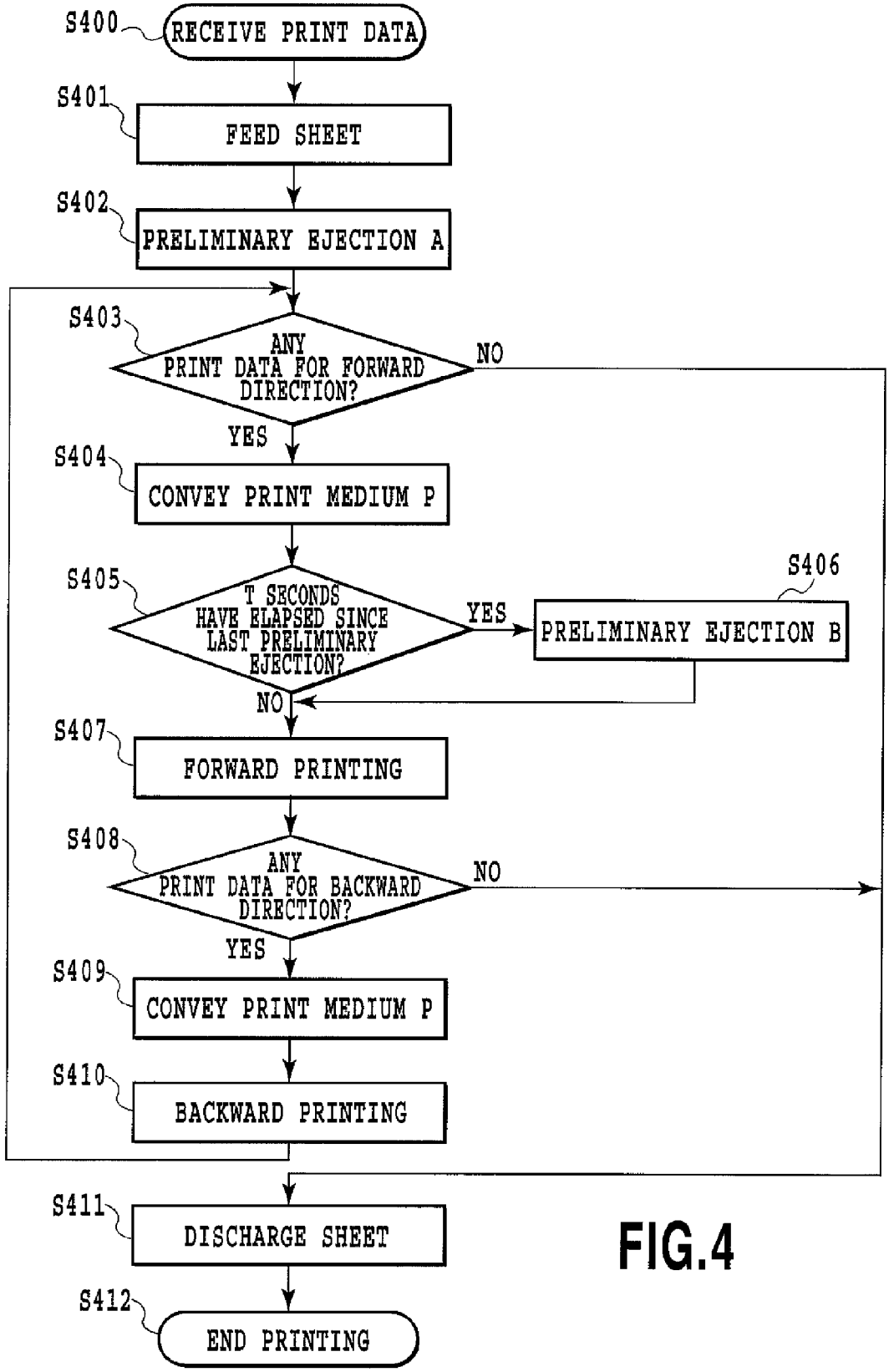
FIG. 4 is a flowchart illustrating a printing operation of the ink jet printing apparatus in accordance with the first embodiment of the present invention.

FIG. 4 is a flowchart illustrating a printing operation of the ink jet printing apparatus in accordance with the present invention. First, in step S400, the ink jet printing apparatus receives print data from a host apparatus. In step S401, the print medium P is fed, and in step S402, a preliminary ejection A described below is performed to provide for printing. Then, in step S403, the process determines whether print data for a forward direction (X direction) is present. If the determination in step S403 is No, the process shifts to step S411 to discharge the sheet to end printing. If the determination in step S403 is Yes, then in step S404, the print medium P is conveyed so that its print area is set in place. The process then proceeds to step S405. In step S405, if the time interval between a preliminary ejection and the following preliminary ejection (hereinafter simply referred to as the time interval t) is defined as n seconds, the process determines whether or not at least n seconds have passed since the last preliminary ejection. If the determination in step S405 is No, forward printing is performed in step S407. If the determination in step S405 is Yes, a preliminary ejection B described below is performed in step S406 and the process then shifts to step S407 to perform forward printing. When the forward printing is finished, step S408 determines whether or not print data for a backward direction (−X direction) is present. If the determination in step S408 is No, the process shifts to step S411 to discharge the sheet and ends printing in step S412. If the determination in step S408 is Yes, then in step S409, the print medium P is conveyed so that its print area is set in place. In step S410, backward printing is performed. When the backward printing is finished, the process returns to step S403 to repeat steps S403 to S410 until the whole printing is finished. In addition, it will be clear from the following description that the time interval of a preliminary ejection is a time interval between time when a sequence of preliminary ejection operations according to a preliminary ejection command has be completed, and time when a sequence of preliminary ejection operations starts according to a next preliminary ejection command.

Figure 5A:
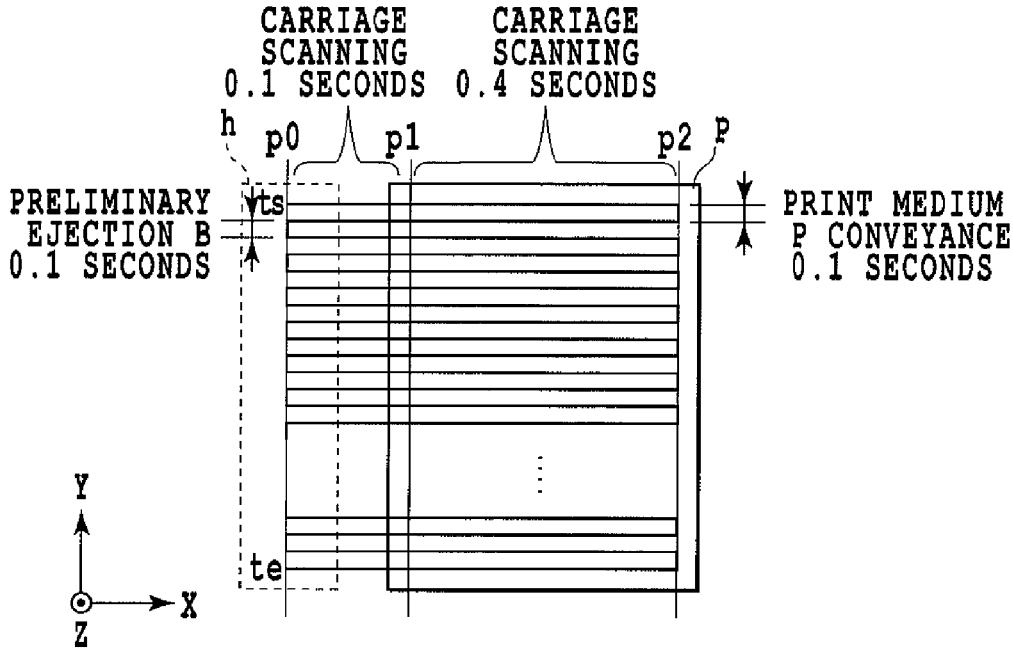
FIG. 5A is a diagram illustrating the operational trajectory of a carriage observed when preliminary ejection time interval is set at 1 second.
Figure 5B:
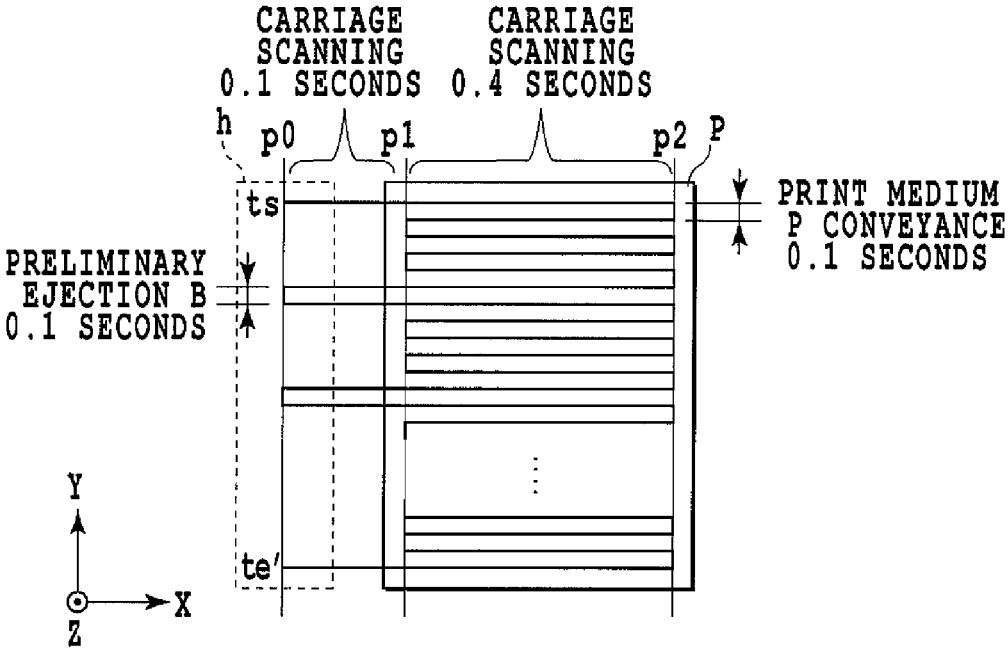
FIG. 5B is a diagram illustrating the operational trajectory of a carriage observed when the preliminary ejection time interval is set at 3 seconds.

FIG. 5A shows the operational trajectory of the carriage 106 observed when an image with a print area of length 8 inches in the X direction and 10.88 inches in the Y direction is printed on the print medium and when the time interval t is set at one second; the carriage 106 is viewed from a Z direction. Actually, the carriage 106 is not moved in the Y direction in conveying the print medium P. However, to simplify the description taking elapsed time into account, FIG. 5 shows the relative relationship between the print medium P and the carriage 106. FIG. 5B shows the case where the time interval t is set at 3 seconds.

FIG. 5A shows a trajectory observed when the time interval is set at 1 second. The carriage 106 completes the preliminary ejection A at a position p0 in the home position h and subsequently starts moving using a time is as a reference, that is, 0 second. Here, the preliminary ejection A is an operation for ejecting 100 droplets of ink from each of the ejection ports, 100 (droplets)×192 (nozzles)×4 (colors)×2 (pl)=153600 pl of ink in total. A startup time from the start of movement of the carriage 106 at the position p0 until the carriage 106 reaches a position p1 at a first end of the print area is 0.1 seconds. Then, the carriage 106 moves at 20 inches/second from the position p1 to a position p2 at a second end of the print area, 8 inches away from the first end of the print area. This requires 8 (inches)/20 (inches/second)=0.4 seconds. When the carriage 106 reaches the position p2 after the forward printing scan, the paper feeding roller 103 and the auxiliary roller 104 covey the print medium P in the Y direction by a distance corresponding to the printed area, that is, 192 (nozzles)/600 (dpi)=0.32 inches. This requires 0.1 seconds. Subsequently, the print head 102 starts printing in the −X direction (backward printing scan) and the carriage 106 moves from the position p1 to the position p2. This requires 0.4 seconds as is the case with the scan in the +X direction. As a result, it takes the carriage 106 0.1+0.4+0.1+0.4=1.0 second to move from the position p0, corresponding to the printing start time, through the positions p1 and p2 and back to the position p1. In this case, the time interval t is set at 1 second. It takes the carriage 106 0.1 seconds to move from the position p1 to the home position p1, and the carriage 106 performs the preliminary ejection B for 0.1 seconds. The ejection B is an operation for ejecting 20 droplets of ink from each of the ejection ports, 20 (droplets)×192 (nozzles)×4 (colors)×2 (p1)=30,720 pl of ink in total. The preliminary ejection B recovers the ejection condition of the print head 102. Further, during the preliminary ejection B, the print medium P is conveyed in the Y direction by 0.32 inches. Consequently, the carriage 106 starts scanning again following the trajectory in the figure. The carriage 106 repeats the above operation. Since this process is one pass printing that completes a predetermined area of image through one printing operation and thus ends at a time to =20.3 seconds after 10.88 (inches)/0.32 (inches/scan) =34 scan printing.

FIG. 5B shows a trajectory observed when the time interval is set at 3 seconds. After the preliminary ejection A is completed at the position p0 in the home position h, the carriage 106 starts moving at a time ts=0 second. A printing scan is performed in which the carriage 106 moves in the X direction with the print heads 102 ejecting ink. Thus, the carriage 106 moves from the position p1 to the position p2, and the print medium P is then conveyed in the Y direction. After the last preliminary ejection A is completed, a printing scan is started with the carriage 106 moving in the −X direction. The printing scan then lasts 1.0 second until the carriage 106 returns to the position p1. However, since the time interval is 3 seconds, the preliminary ejection B is not performed at this time. Instead, printing in the X direction is started again 0.1 seconds after the print medium P is moved 0.32 inches in the Y direction. Subsequently, the carriage 106 continues forward and backward printing for a while and reaches the position P1 after six printing scans. Three seconds have elapsed since the completion of the last preliminary ejection A. Thus, the carriage 106 moves to the position p0 for the first time to perform the preliminary ejection B. The carriage 106 subsequently performs the above operation; it performs 34 scan printing as is the case with the time interval 1 of 1 second and ends the operation at a time te'=18.1 seconds.

With the time interval of 1 second, the amount of time from the start until the end of printing is 20.3 seconds. With the time interval of 3 seconds, the same amount is 18.1 seconds. This indicates that the print speed increases consistently with the time interval t. Further, with the time interval of 1 second, the preliminary ejection B is performed 16 times. With the time interval of 3 seconds, the preliminary ejection B is performed 5 times. This enables the amount of ink used for purposes different from printing to be reduced by 30,720 (pl)×(16−5) (times)=337,920 pl.

FIG. 6 illustrates a comparison of the ejection condition with the time interval t varied and with the distance d between the ejection port surface of the print head 102 and the print surface of the print medium P (hereinafter simply referred to as the distance d). "X" denotes a condition in which increase ink viscosity has varied the impact positions of ink droplets or increase ink density has changed the tone. "66 " denotes a condition in which the impact positions have not been varied but the ink tone has been changed. "O" denotes a favorable condition in which neither of the above phenomena has occurred. For a distance d of 1.5 mm, a time interval t of at most 10 seconds was able to be used. A favorable ejection condition was able to be established at all the examined time intervals t. For a distance d of 1.6 mm, a time interval t of at most 5 seconds was able to be used. Similarly, for a distance d of 1.7 mm, a time interval t of at most 3 seconds was able to be used. For a distance d of 1.8 mm, a time interval t of at most 2 second was able to be used. For a distance d of 1.9 mm, a time interval t of at most 1 second was able to be used. For a distance d of 2 mm, a favorable ejection condition was not able to be established even at time intervals t of 2 seconds. This indicates that a decrease in distance d improves the smoothness with which the first droplets can be ejected, allowing a long time interval t to be used. The reason is assumed to be as follows. A variation in distance d varies the effects of air currents occurring in the vicinity of the ejection ports during an ejecting operation or during movement of the carriage. This increases the viscosity of the ink to reduce ejection speed. A shorter distance d allows almost all the ejected ink droplets to impact the print medium. However, a longer distance d prevents more ink droplets from impacting the print medium under the effects of the air currents.

Here, it is assumed that the distance between the ejection port surface of the print head 102 and a top surface of the platen 107, shown in FIG. 1B, is fixed at 2.00 mm. Then, obviously, the distance d is changed by the thickness of the print medium P. Accordingly, the predetermined thickness of the print medium P allows the distance d to be calculated from the thickness so that on the basis of the calculation, printing can be performed with the optimum time interval t. The ink jet printing apparatus in accordance with the present embodiment does not have any function for automatically recognizing the thickness of the print medium P. Accordingly, the user can manually select the thickness of the print medium to allow the ink jet printing apparatus to recognize the thickness.

FIG. 7 is a table illustrating the relationship between the distance d obtained when the distance between the ejection port surface of the print head 102 and the platen 107 is set at 2.00 mm, the maximum preliminary ejection time interval t for which the normal ejection can be performed over the distance d, and a conventionally set preliminary ejection time interval t. Setting the time interval t on the basis of the table in FIG. 7 enables printing to always be performed under the optimum ejection interval condition. The conventional technique sets the time interval t at, for example, 1 second in order to deal with all thicknesses of print media. However, applying the time interval of 1 second to all the print media causes more preliminary ejections than required to be performed, increasing the consumption of ink not used for printing. Thus, if for example, photographic special paper is printed in accordance with the table in FIG. 7, the time interval t can be set at 3 seconds because the photographic special paper has a large thickness of 0.3 mm. Thus, for a print area of 8 inches×10.88 inches, the present embodiment can achieve printing 20.3–18.1=2.2 seconds faster per sheet than the conventional technique. Further, while the conventional technique requires 16 preliminary ejections to be performed per sheet, the present embodiment requires only 5 preliminary ejections to be performed per sheet. This enables the amount of ink required for purposes different from printing to be reduced by 30,720 (pl)×(16–5)=337,920 pl. Similarly, if relatively thick print media such as postcards, envelopes, or CD-Rs are printed, the present embodiment can perform printing at an increased speed with reduced ink consumption compared to the conventional technique.

Thus, the user allows the ink jet printing apparatus to recognize the thickness of the print medium P to set the optimum preliminary ejection time interval t on the basis of the thickness. The present embodiment has thus allowed the first droplets of ink to be more smoothly ejected. This has made it possible to prevent a possible decrease in print speed and the possible degradation of the printing capability in association with the ink amount and to reduce the high demand for the capacity of a waste ink absorber.

(Second Embodiment)

According to the first embodiment, the user allows the ink jet printing apparatus to recognize the thickness of the print medium P. However, in the present embodiment, description will be given of an ink jet printing apparatus comprising means for automatically recognizing the distance d between the ejection port surface of the print head and the print surface of the print medium.

Figure 8A:
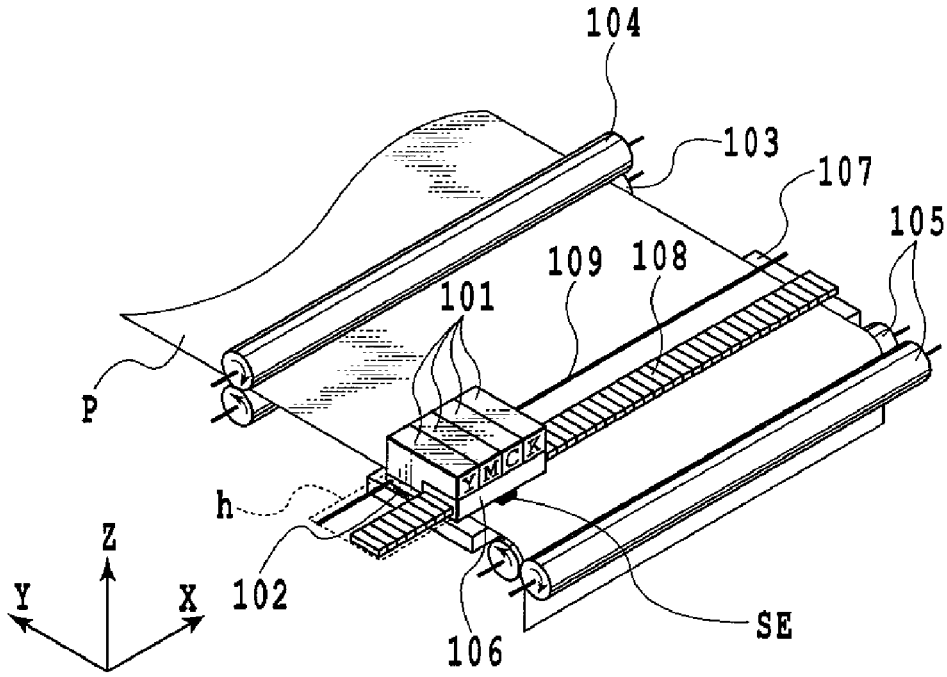
FIG. 8A is a perspective view of an ink jet printing apparatus in accordance with a second embodiment.
Figure 8B:
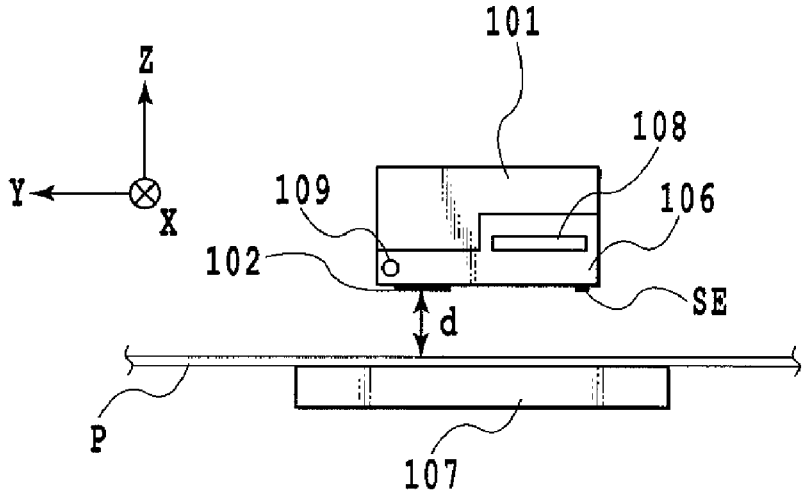
FIG. 8B is a plan view of a side surface of the ink jet printing apparatus in accordance with the second embodiment.

FIG. 8A is a perspective view of an ink jet printing apparatus in accordance with an embodiment of the present invention. FIG. 8B is a plan view of the ink jet printing apparatus as viewed from the X direction in FIG. 8A. The ink jet printing apparatus in accordance with the present embodiment corresponds to the ink jet printing apparatus in accordance with the first embodiment additionally having a sensor SE that optically reads the distance d between the ejection port surface of the print head 102 and the print surface of the print medium P. The remaining part of the configuration is the same as that of the first embodiment.

FIG. 9 is a table illustrating the relationship between the distance d detected by the sensor SE and the time interval t. The ink jet printing apparatus itself selects and sets the time interval t on the basis of the table in FIG. 9. This control enables the time interval t to be set longer if the distance d between the ejection port surface of the print head 102 and the print surface of the print medium P is shorter. The present embodiment has thus allowed the first droplets of ink to be more smoothly ejected. This has made it possible to prevent the inappropriate ejection of the first droplets and a possible decrease in print speed and the possible degradation of the printing capability in association with the ink amount and to reduce the high demand for the capacity of a waste ink absorber.

(Third Embodiment)

As described above, the increased preliminary ejection time interval t allows the print speed and the printing capability to be improved. An increase in preliminary ejection time interval t requires a reduction in the distance d between the ejection port surface of the print head 102 and the print surface of the print medium P is shorter. Thus, in the present embodiment, description will be given of an ink jet printing apparatus that can vary the distance between the ejection port surface of the print head and the print surface of the print medium by controlling the carriage position and the platen position.

The ink jet printing apparatus in accordance with the present embodiment comprises the ink jet printing apparatus described in the first embodiment, the sensor SE that optically reads the distance d between the ink jet print head and the print medium, and a mechanism that can vary the distance d. The mechanism capable of varying the distance d is provided on the carriage belt 108, the carriage shaft 109, or the platen 107 to set the distance d between the ejection port surface of the print head 106 and the print surface of the print medium P at multiple levels. The remaining part of the configuration is the same as that of the first embodiment.

Figure 10:
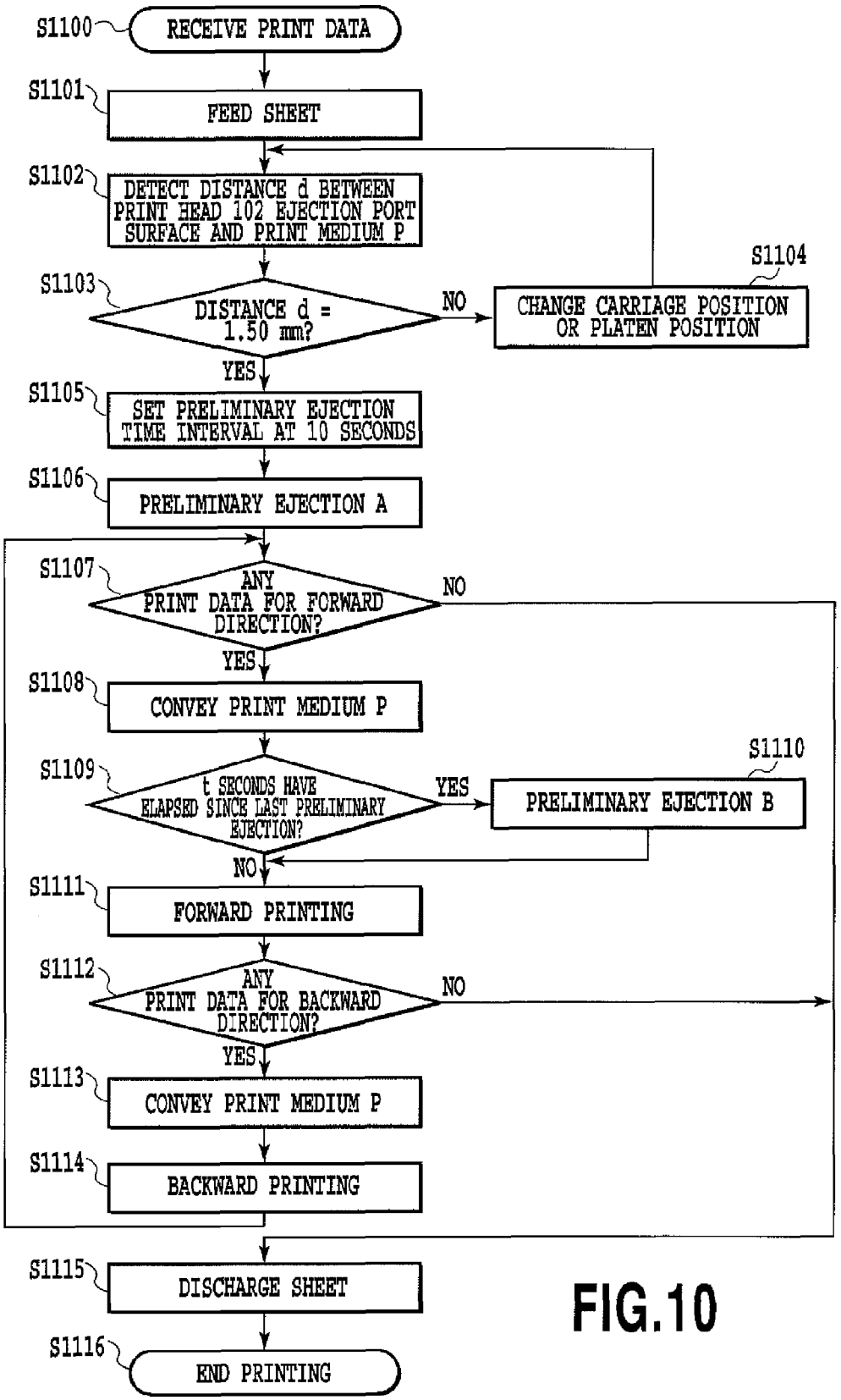
FIG. 10 is a flowchart showing control performed in an ink jet printing apparatus in accordance with a third embodiment.

FIG. 10 is a flowchart illustrating control performed by the ink jet printing apparatus in accordance with the present embodiment. In step S1100, the ink jet printing apparatus receives print data from the host apparatus. Then, in step S1101, the sheet feeding roller 105 feeds the print medium P. Normally, when the print medium P is fed, the distance d between the ejection port surface of the print head 102 and the print surface of the print medium P is set at the minimum value of 1.5 mm, at which there is no possibility that the print head 102 rubs against the print medium P. However, for confirmation, the sensor SE detects the distance d in step S1102, and step S1102 then determines whether or not the detected distance d is 1.5 mm. If the determination in step S1103 is Yes, then in step S1103, then on the basis of FIG. 6 for the first embodiment, the preliminary ejection time interval is set at 10 seconds in step S1105. The preliminary ejection A is then performed in step S1106. If the determination in step S1103 is No, then in step S1104, the distance d is changed to 1.5 mm by controlling the position of the carriage 106 by means of the carriage belt 110 and the carriage shaft 111 or controlling the position of the platen 112. The part of the flow which follows the preliminary ejection in step S1106 is the same as that which follows the preliminary ejection in step S402, and will thus not be described.

Figure 11A:
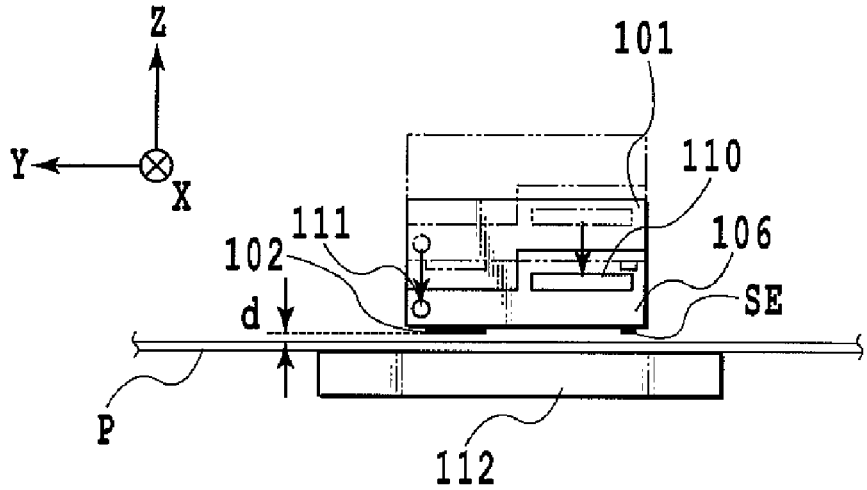
FIG. 11A is a diagram showing an arrangement that moves a carriage via a carriage belt and a carriage shaft.
Figure 11B:
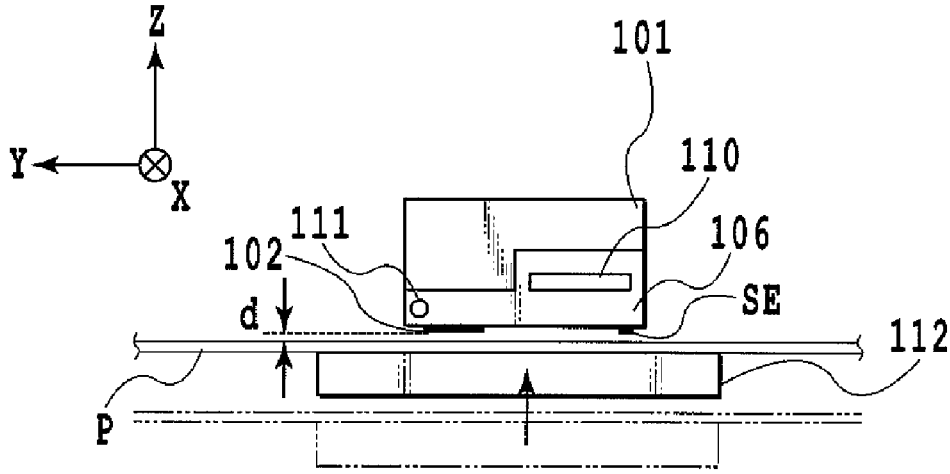
FIG. 11B is a diagram showing an arrangement that moves a platen.

FIG. 11A is a diagram illustrating an arrangement that moves the carriage belt 110 and the carriage shaft 111 and thus the carriage 106 to change the distance d. FIG. 11B shows an arrangement that moves the platen 112.

If the distance d is changed by the carriage belt 110 and the carriage shaft 111, the carriage belt 110 and the carriage shaft 111 are simultaneously translated perpendicularly to the print surface until the distance d reaches 1.5 mm. If the distance d is changed by the platen 112, the platen 112 is translated perpendicularly to the print surface of the print medium P until the distance d reaches 1.5 mm.

Referring back to FIG. 10, after the distance d is changed, the process proceeds to step S1102 to sense the distance d to check whether or not the distance d=1.5 mm. When the distance d=1.5 mm is confirmed, the process shifts to step S1105 to set the preliminary ejection time interval at 10 seconds. Then, in step S1106, the preliminary ejection A is performed to prepare for printing. Here, the preliminary ejection A is an operation for ejecting 100 droplets of ink from each of the ejection ports, 100 (droplets)×192 (nozzles)×4 (colors)×2 (pl)=153,600 pl of ink in total. Then, step S1107 determines whether or not data for forward printing is present. If the determination in step S1107 is No, then in step S1115, the paper feeding roller 103 and the auxiliary roller 104 discharge the sheet to finish printing.

If the determination in step S1107 is Yes, then in step S1108, the paper feeding roller 103 and the auxiliary roller 104 convey the print medium P until the print area is set in place. Step S1109 determines whether or not 10 seconds has elapsed since the last preliminary ejection. If the determination in step S1109 is No, the print heads 102 perform forward printing in step S1111. If the determination in step S1109 is Yes, the preliminary ejection B is performed in step S1110 and the print head 102 then performs forward printing in step S1111. The ejection B is an operation for ejecting 20 droplets of ink from each of the ejection ports, 20 (droplets)×192 (nozzles)×4 (colors)×2 (pl)=30,720 pl of ink in total. After the forward printing is finished, the process following step S1112 is the same as that following step S408 in FIG. 4.

As already described, the increased time interval t reduces the number of preliminary ejections required, enabling a reduction in print speed and in the amount of ink used for purposes different from printing. If only the preliminary ejection time interval t is changed with the other settings remaining unchanged, then a preliminary ejection time interval t of 1 second requires 16 preliminary ejections B to be performed between the start and end of printing, and requires 20.3 seconds for printing. However, a preliminary ejection time interval t of 10 seconds requires only one preliminary ejection B to be performed, and requires 17.3 seconds for printing. The print time can thus reduced by 20.3−17.3=3.0 seconds, enabling the amount of ink required for purposes different from printing to be reduced by 30,720 (pl)×(16−1)=460,800 pl.

The first and second embodiments vary the time interval t on the basis of the distance d. The first and second embodiments thus fail to increase the time interval t above the conventional value of 1 second if the print medium has a small thickness of less than 0.2 mm as in the case of ordinary paper and coat paper, that is, if the distance d is longer than 1.8 mm. The present embodiment varies the distance d to enable the time interval to be set at 10 seconds regardless of the thickness of the print medium. This allows a reduction in the number of preliminary ejections required, enabling printing to be performed at a high speed with reduced ink consumption.

(Other Embodiments)

Thus, the carriage position or the platen position is controlled in accordance with the desired time interval to vary the distance between the ejection port surface of the print head and the print medium. As a result, the first droplets of ink have been able to be more smoothly ejected. This has made it possible to prevent a possible decrease in print speed and the possible degradation of the printing capability in association with the ink amount and to reduce the high demand for the capacity of a waste ink absorber.

In the above embodiments, the sensor SE is mounted on the carriage 106. However, the present invention is not limited to this. The sensor SE may be mounted in any place provided that the distance d between the ejection port surface of the print head 102 and the print surface of the print medium P can be detected (for example, the carriage shaft 109 may be provided separately from the carriage 106 so that the sensor SE can be fixed to the carriage shaft 109).

The above embodiments use the optical sensor as the sensor SE sensing the distance d. However, the present invention is not limited to this. It is possible to use, for example, a pressure sensor that senses the thickness of the print medium on the basis of force exerted on the roller.

The above embodiments use the ink jet printing apparatus based on the bubble jet scheme which uses the electromagnetic converters to generate energy required to eject ink. However, the present invention is not limited to this. The ink jet printing apparatus may use piezo elements.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-158845, filed Jun. 7, 2006, which is hereby incorporated by reference herein in its entirety.

What is claimed is:

1. An ink jet printing apparatus that prints on a print surface of a print medium using a print head provided with an ejection port forming surface where an ejection port to eject ink is formed, the ink jet printing apparatus, further comprising:

a setting unit configured to set a time interval between preliminary ejections during the printing operation, wherein said setting unit sets the time interval in accordance with a distance between the ejection port forming surface and the print surface of the print medium.

2. The ink jet printing apparatus according to claim 1, wherein said setting unit increases the time interval in accordance with a reduction in the distance between the ejection port forming surface and the print surface of the print medium.

3. The ink jet printing apparatus according to claim 1, wherein said setting unit sets the time interval so that when the distance between the ejection port forming surface and the print surface of the print medium is a first distance, the time interval is longer than when the distance is a second distance greater than the first distance.

4. The ink jet printing apparatus according to claim 1, wherein said setting unit sets the time interval so that when the distance between the ejection port forming surface and the print surface of the print medium is less than a predetermined distance, the time interval is longer than that set when the distance is greater than the predetermined distance.

5. The ink jet printing apparatus according to claim 1, wherein said setting unit calculates the distance between the ejection port forming surface and the print surface of the print medium based on information about a thickness of the print medium, and sets the time interval in accordance with the calculated results.

6. The ink jet printing apparatus according to claim 1, further comprising:

a sensor capable of detecting a distance between the print surface of the print medium and an ejection port forming surface of the print head, wherein said setting unit sets the time interval based on the distance detected by said sensor.

7. An ink jet printing method comprising:

a printing step of printing on a print surface of a print medium using a print head having an ejection port forming surface on which an ejection port for ejecting an ink is formed;

a setting step that sets a time interval between preliminary ejections during the printing operation;

wherein said setting step sets the time interval in accordance with a distance between the ejection port forming surface and the print surface of the print medium.

* * * * *